United States Patent [19]

Yamasoe et al.

[11] Patent Number: 4,886,616

[45] **Date of Patent: * Dec. 12, 1989**

[54] ALUMINUM SURFACE CLEANING AGENT

[75] Inventors: Katsuyoshi Yamasoe, Chiba; Kiyotado Yasuhara; Satoshi Ikeda, both of Kanagawa, all of Japan

[73] Assignee: Amchem Products, Inc., Ambler, Pa.

[ * ] Notice: The portion of the term of this patent subsequent to Mar. 1, 2005 has been disclaimed.

[21] Appl. No.: 80,527

[22] Filed: Jul. 31, 1987

Related U.S. Application Data

[62] Division of Ser. No. 793,019, Oct. 30, 1985, Pat. No. 4,728,456.

[30] Foreign Application Priority Data

Oct. 30, 1984 [JP] Japan ..... 59-22996

[51] Int. Cl.[4] ..... C11D 7/08

[52] U.S. Cl. ..... 252/142; 252/79.2; 252/79.4; 134/3; 134/41; 156/665; 148/23; 148/24; 423/132; 423/556

[58] Field of Search ..... 252/142, 146, 147, 173, 252/79.2; 134/3, 41; 156/665; 148/23, 24; 423/132, 556

[56] References Cited

U.S. PATENT DOCUMENTS

| | | | |
|---|---|---|---|
| 3,275,562 | 11/1963 | Smith | 252/147 |
| 3,510,430 | 5/1970 | Mickelson et al. | 252/79.1 |
| 3,728,188 | 4/1973 | Yarrington | 156/22 |
| 3,954,645 | 5/1976 | Otrhalek et al. | 252/101 |
| 4,100,015 | 7/1978 | Russell | 156/665 |
| 4,212,701 | 7/1980 | Russell et al. | 156/665 |
| 4,435,223 | 3/1984 | Dollman | 134/3 |

FOREIGN PATENT DOCUMENTS 1417422 4/1965 France .

*Primary Examiner*—A. Lionel Clingman
*Assistant Examiner*—Hoa Van Le
*Attorney, Agent, or Firm*—Ernest G. Szoke; Wayne C. Jaeschke; Real J. Grandmaison

[57] ABSTRACT

Chromium free cleaning compositions for cleaning aluminum and aluminum alloy surfaces comprising A. from 0.2–4 g/l ferric ion and B. sufficient sulfuric and/or nitric acid to produce a pH of 2 or less.

The invention also relates to compositions containing from 0.001–0.5 g/l of fluoride ions.

8 Claims, No Drawings

ALUMINUM SURFACE CLEANING AGENT

Conventionally, as the acid cleaner a chromic acid type cleaner has been used in order to prevent corrosion of the treatment apparatus, but the use of these cleaners has been eliminated because of the toxicity of the chromium ion. As substitutes, hydrofluoric acid cleaning agents have been proposed. For example, according to U.S. Pat. No. 3,728,188, a cleaning agent has been proposed which consists of an acidic aqueous solution containing 0.5–2.0 g/l fluoride ion, 5–21 g/l ferric ion, and 0.05–3.0 g/l thiourea, the pH of which is regulated to 0.1–1.8 with a strong mineral acid such as sulfuric acid, etc. With this cleaner, satisfactory surface cleaning is accomplished due to the fact that the large quantity of fluoride ions causes a rapid rate of etching the aluminum, while on the other hand, this etching is inhibited by the ferric ions.

However, in the case of fluoride ions special care must be employed with respect to preventing pollution of the working environment and waste liquid treatment, due to their toxicity. This is also true, not only for the case in which hydrofluoric acid is used, but also for systems in which other fluorides are present which introduce fluoride ions into the cleaner.

Cleaners with small quantities of fluoride ions, which are a problem in this respect, have also been known conventionally. For example, according to a British Pat. No. 1,454,974, a cleaner has been proposed which consists of an aqueous acidic solution containing 0.005–0.1 g/l fluoride ions and 1–10 g/l sulfuric acid, and which has a pH of 1.0–1.8. Although the fluoride ion content is reduced in this way, its toxicity can by no means be neglected. Moreover, in this cleaner, the cleaning power is somewhat reduced along with the reduction in fluoride ion content.

DESCRIPTION OF THE INVENTION

Other than in the operating examples, or where otherwise indicated, all numbers expressing quantities of ingredients or reaction conditions used herein are to be understood as modified in all instances by the term "about."

This invention concerns a cleaner for aluminum surfaces. More specifically, it concerns a cleaner which can satisfactorily remove lubricating oil or aluminum powder (smut), etc., which has adhered to the surface of aluminum due to the molding process, and provide a clean surface.

An object of this invention is to provide an aluminum surface cleaner which not only contains no chromium ions, but also contains no fluoride ions, or at most only a small quantity of them.

According to the invention, an aluminum surface cleaner is provided which is an aqueous acidic solution which contains 0.2–4 g/l ferric ions, but contains no chromium or fluoride ions, and having its pH regulated to 2.0 or less with sulfuric acid and/or nitric acid. The present invention also provides an aluminum surface cleaner which is an aqueous acidic solution which contains 0.2–4 g/l ferric ions and 0.001–0.5 g/l fluoride ions and does not contain chromium ions, and which has its pH regulated to 2.0 or less with sulfuric acid and/or nitric acid.

The chromium ions referred to above which are not present in the compositions of the invention include not only hexavalent chromium ions provided by anhydrous chromic acid, but also trivalent chromium ions of its reduction product, or complex ions (e.g., $[Cr(OH_2)_6]^{3+}$) provided by chromium compounds of various kinds (e.g., $[Cr(OH_2)_6]Cl_3$). The fluoride ions referred to the include not only the $F^{\ominus}$ ion, supplied by hydrofluoric acid, but also complex ions (e.g., $[AlF_6]^{3-}$) supplied by various kinds of fluorine compounds (e.g., $Na_3[AlF_6]$).

In the cleaner of this invention, the etching of the aluminum by the sulfuric acid or nitric acid is thought to be promoted by the ferric ions; this promotion mechanism is suspected to be due to a cathode reaction $Fe(III)+e^- \rightarrow Fe(II)$. This promotion effect is great compared to that of other oxidants (e.g., $HClO_4$, $H_2M_0O_4$, $H_2B_2O_7$). The content of these ferric ions in the cleaner is 0.2–4 g/l. If the content is too small, the effect of promoting the etching rate will be small, and it will not be suitable as a cleaner. On the other hand, if it is too great, a promotion effect proportional to the quantity used will not be obtained if fluoride ions are also present, and the etching ability due to the fluoride ions will be suppressed, so that satisfactory surface cleaning connot be accomplished.

As the source of these ferric ions there can be used water-soluble ferric salts such as $Fe_2(SO_4)_3$, $Fe(NO_3)_3$, $Fe(ClO_4)_3$, etc. Of course, salts which also supply chromium ions, e.g., $Fe_2(CrO_4)_3$, $(NH_4)Fe(CrO_4)_2$, etc., cannot be used. In the cleaner of this invention, if fluoride ions are also present, compounds such as $FeF_3$, $Na_3FeF_6$, etc., can be used. Ferrous salts (such as $FeSO_4$, $Fe(NO_3)_2$, etc.) can also be used as sources of ferric ions. In this case, an equivalent quantity of oxidant (e.g., hydrogen peroxide) can be added to the aqueous acidic solution into which the ferrous salt has been compounded to oxidize the required quantity of ferrous ions to ferric ions.

As discussed above, the present invention also relates to cleaning agents that contain fluoride ions, present in from 0.001–0.5 g/l (as $F^{\ominus}$ ion). If the content of fluoride ions is too small, the effect of adding them is not obtained, the etching ability is not increased, and consequently, their use will not be advantageous if the aim is to shorten the cleaning time. On the other hand, if their content is too great, it will be meaningless from the viewpoint of eliminating toxicity, and excessive etching will occur.

As sources of the fluoride ions one can use the above-mentioned various kinds of fluorides, including hydrofluoric acid, and the above-mentioned fluorides which can also supply ferric ions.

The cleaning agents of this invention are aqueous acidic solutions with a pH of 2.0 or less, preferably pH 0.6–2.0. If the pH is too high, the aluminum etching rate is extremely reduced, and the effectiveness of the cleaner cannot be obtained. There is no particular lower limit to the pH, but even if it is less than pH 0.6, no further improvement is observed in cleaning power, and it is not commercial; it is also disadvantageous from the viewpoint of preventing corrosion of the treatment apparatus.

The pH regulation is obtained with sulfuric acid and/or nitric acid. Furthermore, with nitric acid, there is the concern that decomposition gases (e.g., NO, $N_2O_4$) are produced during the cleaning treatment; hence, it is preferable to use sulfuric acid.

The use of other strong acids besides sulfuric acid and nitric acid, e.g., hydrofluoric acid, is limited due to the above-mentioned toxicity and strong etching ability of fluoride ions. With hydrochloric acid, when ferric ions are also present, pitting is caused on the aluminum surface, and poor external appearance is invited; in addition, edge-cracking during processing occurs. With phosphoric acid, there is the problem that a large etching rate reduction occurs due to eluted aluminum ions. Consequently, it is not desirable to use such acids, but they may be used together with the above-mentioned sulfuric acid and/or nitric acid in a range which will not interfere with desired results of this invention.

With the cleaning agents of this invention it is advantageous to include, as with conventionally-known cleaners, 0.1–10 g/l, preferably 0.5–4 g/l, of one or more surface active agents. In this way, the ability to remove the above-mentioned lubricating oil will be improved. As the surface active agent there can be used nonionic, cationic, anionic or amphoteric agents, as with conventional cleaners.

Furthermore, when necessary, chelating agents (e.g., citric acid, oxalic acid, tartaric acid) can be compounded in. In this way, the etching rate is accelerated, and this as advantageous for improving the treated external appearance.

The cleaner of this invention, like conventionally-known cleaners, can be used by preparing a concentrated aqueous liquid from the above-mentioned ingredients and diluting it to a concentration within the range of use by a suitable quantity of water.

The application of the cleaner to the aluminum surface can be carried out by the immersion or the spray method. The temperature of application can be room temperature (20° C.) to 80° C., preferably 50°–70° C. The application time varies with the above-mentioned method of application and application temperature, and the state of contamination of the object to be treated, but ordinarily it is 10–120 sec.

The aluminum surface cleaned by the cleaner of this invention can also be treated by normal methods, e.g., phosphating, after washing with water.

With the compositions of the invention satisfactory cleaning of aluminum surfaces can be obtained, yet the cleaner contains no chromium ions and no fluorine ions or, alternatively, only a small quantity of fluorine ions, which have previously been used in large quantities because of their usefulness. Hence, pollution of the work environment can be substantially prevented and the burden of waste liquid treatment reduced.

The invention will be illustrated but not limited by the following examples.

ACTUAL EXAMPLES 1–9 AND COMPARISON EXAMPLES 1–8

(1) Objects to be Treated

Lidless containers with lubricatng oil and smut adhering, obtained by the DI process of 3004 alloy aluminum plate.

(2) Cleaner 1 l of cleaner was prepared by mixing 16.7 g of 75% sulfuric acid, 14.3 g of 20% aqueous solution of $Fe_2(SO_4)_3$, and the nonionic surface active agent (1) with water (Actual Example 1).

Thereafter, the cleaning agents with compositions shown in Table 1 were prepared in the same way.

The surface active agents used were as follows:

Nonionic agent (1): Hydrocarbon derivative
Nonionic agent (2): Abietic acid derivative
Nonionic agent (3): Primary ethoxylated alcohol
Nonionic agent (4): Denatured polyethoxylated alcohol

(3) Treatment Conditions

The above-mentioned containers were spray-treated for 60 sec. at 60°–70° C. with the various cleaners, then spray-washed at room temperature for 15 sec. with tap water and then for 5 sec. with deionized water, after which they were dried at 95° C.

(4) Cleaning Power Evaluation

The following items were tested: the results are shown in Table 2.

(a) External appearance: The whiteness of the container after drying was judged by eye. The case in which degreasing and de-smutting were complete and a fully etched white external appearance was shown is rated as good; and evaluation was made based on the 5 stages given below according to the degree of whitening:

○: whole surface whitened
O: partially light gray
Δ: whole surface light gray
X: partially gray
XX: whole surface gray

TABLE 1

| | Ferric ion, g/l | Fluorine ion, g/l | Sulfuric acid (100% converted), g/l | Nitric acid (100% converted) g/l | Surface active agent g/l | Other ingredients, g/l | pH | Treatment temperature, °C. |
|---|---|---|---|---|---|---|---|---|
| Actual example | | | | | | | | |
| 1 | 1.0 | — | 12.5 | — | nonionic type (1) 0.4, nonionic type (2) 0.8 | — | 0.98 | 70 |
| 2 | 0.5 | — | 12.5 | — | " | — | 0.93 | 70 |
| 3 | 1.0 | — | 7.5 | — | " | — | 1.45 | 70 |
| 4 | 1.0 | — | 12.5 | — | nonionic type (1) 3.8, nonionic type (2) 3.8 | — | 0.98 | 70 |
| 5 | 3.0 | — | 12.5 | — | nonionic type (1) 0.4, nonionic type (2) 0.8 | — | 0.90 | 70 |
| 6 | 0.5 | — | 12.5 | — | " | — | 1.70 | 70 |
| 7 | 1.0 | — | — | 12.5 | " | — | 0.90 | 70 |
| 8 | 1.0 | — | 12.5 | 2.0 | " | — | 1.10 | 70 |
| 9 | 1.0 | 0.02 | 12.5 | — | " | — | 1.10 | 70 |
| Comparison example | | | | | | | | |
| 1 | — | — | 1.6 | — | nonionic type (3) 1.3, nonionic type (4) 0.66 | phosphoric acid (100%) 2.5, | 1.5 | 80 |

TABLE 1-continued

| | Ferric ion, g/l | Fluorine ion, g/l | Sulfuric acid (100% converted), g/l | Nitric acid (100% converted) g/l | Surface active agent g/l | Other ingredients, g/l | pH | Treatment temperature, °C. |
|---|---|---|---|---|---|---|---|---|
| | | | | | | citric acid 0.63, oxalic acid 0.31 | | |
| 2 | — | — | 8.5 | — | nonionic type (1) 3.8, nonionic type (2) 3.8 | — | 1.2 | 60 |
| 3 | — | — | 12.5 | — | nonionic type (1) 0.4, nonionic type (2) 0.8 | — | 0.95 | 70 |
| 4 | — | — | 7.5 | — | " | — | 2.2 | 70 |
| 5 | 0.1 | — | 12.5 | — | nonionic type (1) 0.4, nonionic type (2) 0.8 | — | 0.90 | 70 |
| 6 | 1.0 | — | 2.7 | — | " | — | 2.14 | 70 |
| 7 | — | 1.0 | 12.5 | — | " | — | 1.10 | 70 |
| 8 | 7 | 1.0 | 12.5 | — | " | — | 1.10 | 70 |

TABLE 2

| | External appearance | | Water wettability | De-smutting ability |
|---|---|---|---|---|
| Actual example | 1 | ◎ | 100% | 5 |
| | 2 | ◎ | 100 | 5 |
| | 3 | ◎ | 100 | 4 |
| | 4 | ◎ | 100 | 5 |
| | 5 | ◎ | 100 | 5 |
| | 6 | ◎ | 100 | 4 |
| | 7 | ◎ | 100 | 5 |
| | 8 | ◎ | 100 | 5 |
| | 9 | ◎ | 100 | 5 |
| Comparison example | 1 | Δ | 80 | 3 |
| | 2 | × | 100 | 3 |
| | 3 | × | 100 | 3 |
| | 4 | × | 90 | 2 |
| | 5 | Δ | 100 | 3 |
| | 6 | Δ | 100 | 3 |
| | 7 | ○ | 100 | 4 |
| | 8 | ○ | 100 | 4 |

(b) Water wettability: Immediately after the water spray washing, the container was shaken 3 times to remove the water, after which the container was set down upright, and after 30 sec. the outer surface area of the container wetted with water (%) was measured.

(c) De-smutting ability: Transparent adhesive tape was stuck to the inner surface of the container after drying, and it was then pulled off and stuck to white cardboard. The whiteness of the surface with the tape stuck to it was compared to the other part of the cardboard. The case in which the smut was completely removed and the surface had no contamination was considered good, and evaluation was made based on the 5 stages below according to the degree of contamination:

5: no contamination
4: traces of contamination
3: very minute contamination
2: moderate contamination
1: great contamination

What is claimed:

1. An aqueous chromium free, fluoride free cleaning composition for aluminum and aluminum alloy surfaces consisting of:

A. from about 0.2 to about 4 g/l of ferric ions; and

B. a sufficient quantity of sulfuric and/or nitric acid to produce a pH of 2 or less for the composition.

2. A composition in accordance with claim 1 wherein component B is sulfuric acid.

3. A composition in accordance with claim 1 wherein the pH of the composition is in the range of from about 0.6 to about 2.0.

4. A process for cleaning aluminum and aluminum alloy surfaces comprising the steps of I. treating an aluminum or aluminum alloy surface at a temperature in the range of about 20° C. to about 80° C. with an aqueous chromium free, fluoride free cleaning solution consisting of:

A. from about 0.2 to about 4 g/l of ferric ions, and

B. a sufficient quantity of sulfuric and/or nitric acid to produce a pH of 2 or less for the composition; and II. removing the aqueous cleaning solution from the aluminum or aluminum alloy surface.

5. A process in accordance with claim 4, wherein component I.B. is sulfuric acid.

6. A process in accordance with claim 4 wherein the pH of the cleaning solution is in the range of from about 0.6 to about 2.0.

7. An aqueous chromium-free, fluoride-free cleaning composition for aluminum and aluminum alloy surfaces consisting of:

A. from about 0.2 to about 4 g/l of ferric ions;

B. a sufficient quantity of sulfuric and/or nitric acid to produce a pH of 2 or less for the composition; and C. from about 0.1 to about 10 g/l of a surfactant.

8. A process for cleaning aluminum and aluminum alloy surfaces comprising the steps of I. treating an aluminum or aluminum alloy surface at a temperature in the range of about 20° C. to about 80° C. with an aqueous chromium-free, fluoride-free cleaning solution consisting of:

A. from about 0.2 to about 4 g/l of ferric ions;

B. a sufficient quantity of sulfuric and/or nitric acid to produce a pH of 2 or less for the composition; and C. from about 0.1 to about 10 g/l of a surfactant; and II. removing the aqueous cleaning solution from the aluminum or aluminum alloy surface.

* * * * *